US012435960B2

(12) United States Patent
Lotti et al.

(10) Patent No.: US 12,435,960 B2
(45) Date of Patent: Oct. 7, 2025

(54) ARTICULATING INLET FOR AIRBREATHING EXTENDED RANGE PROJECTILES AND MISSILES

(71) Applicant: Raytheon Company, Arlington, VA (US)

(72) Inventors: Andrew J. Lotti, Tucson, AZ (US); Shawn P. Burke, Vail, AZ (US); Donald G. Messitt, Folsom, CA (US); Jaylan S. Jones, Tucson, AZ (US)

(73) Assignee: Raytheon Company, Arlington, VA (US)

( * ) Notice: Subject to any disclaimer, the term of this patent is extended or adjusted under 35 U.S.C. 154(b) by 418 days.

(21) Appl. No.: 17/379,149

(22) Filed: Aug. 2, 2021

(65) Prior Publication Data

US 2022/0170722 A1 Jun. 2, 2022

Related U.S. Application Data

(60) Provisional application No. 63/119,692, filed on Dec. 1, 2020.

(51) Int. Cl.
*F42B 10/14* (2006.01)
*F42B 15/10* (2006.01)

(52) U.S. Cl.
CPC ..... *F42B 10/14* (2013.01); *F42B 15/105* (2013.01)

(58) Field of Classification Search
None
See application file for complete search history.

(56) References Cited

U.S. PATENT DOCUMENTS 3,576,298 A * 4/1971 Barnett ..... B64G 1/14 244/159.3
4,667,899 A * 5/1987 Wedertz ..... F42B 10/14 244/3.28

(Continued)

FOREIGN PATENT DOCUMENTS

AU 2021390428 5/2023
EP 4256270 10/2023

(Continued)

OTHER PUBLICATIONS

International Search Report and Written Opinion mailed Apr. 25, 2022 in corresponding International Application No. PCT/US2021/043130.

(Continued)

*Primary Examiner* — Kimberly S Berona
*Assistant Examiner* — Nevena Aleksic
(74) *Attorney, Agent, or Firm* — Schwegman Lundberg & Woessner, P.A.

(57) ABSTRACT

A projectile includes a wing structure to form both an inlet that intakes air for combustion by a propulsion system of the projectile during an initial range of flight, and a lift surface for the projectile after the propulsion engine of the propulsion system burns out. The wing structure acts as both the inlet and the lift surface to enable both a long range and an optimal time of flight for the projectile to the target. The wing structure includes at least one wing that is movable from a folded position, in which the wing extends along a propulsion body section of the projectile to define the inlet, to a deployed position, in which the wing extends outwardly from the propulsion body section to form the lift surface. Any number of wings may be provided and the wings may be simultaneously deployed or sequentially deployed depending on the application.

18 Claims, 4 Drawing Sheets

(56) References Cited

U.S. PATENT DOCUMENTS

| | | | | |
|---|---|---|---|---|
| 7,950,235 | B1 * | 5/2011 | Giddings | F02K 7/08 60/767 |
| 2015/0338200 | A1 | 11/2015 | Vainshtein et al. | |
| 2017/0328692 | A1 * | 11/2017 | Solberg | F42B 15/10 |
| 2018/0312251 | A1 * | 11/2018 | Petrov | B64D 27/12 |
| 2020/0240757 | A1 | 7/2020 | Pinoteau | |

FOREIGN PATENT DOCUMENTS

| | | | |
|---|---|---|---|
| FR | 866598 | A | 8/1941 |
| GB | 2569236 | A | 6/2019 |
| IN | 202317042649 | | 8/2024 |
| JP | H05187319 | | 7/1993 |
| JP | H09101098 | | 4/1997 |
| JP | 2008528917 | | 7/2008 |
| JP | 2017534042 | | 11/2017 |
| JP | 2023551306 | | 12/2023 |
| KR | 20230107339 | | 7/2023 |
| WO | 2016/070930 | A1 | 5/2016 |
| WO | 2022119606 | | 6/2022 |

OTHER PUBLICATIONS

"Japanese Application Serial No. 2023-532675, Response filed Aug. 2, 2024 to Notification of Reasons for Refusal mailed May 14, 2024", W English Claims, 9 pgs.

"International Application Serial No. PCT US2021 043130, International Preliminary Report on Patentability mailed Jun. 15, 2023", 9 pgs.

"Japanese Application Serial No. 2023-532675, Notification of Reasons for Refusal malled May 14, 2024", With English Machine Translation, 9 pgs.

* cited by examiner

ARTICULATING INLET FOR AIRBREATHING EXTENDED RANGE PROJECTILES AND MISSILES

RELATED APPLICATIONS

This application claims the benefit of U.S. Provisional Application No. 63/119,692 filed Dec. 1, 2020, which is hereby incorporated herein by reference in its entirety.

GOVERNMENT LICENSE RIGHTS

This disclosure was made with Government support under contract number DOTC-19-01-INIT0845, awarded by the Department of Defense. The Government has certain rights in the disclosure.

FIELD OF DISCLOSURE

The disclosure relates to inlets for projectiles and missiles.

DESCRIPTION OF RELATED ART

Projectiles, such as missiles typically have space constraints such that the space must be balanced for both guidance electronics and a propulsion system. In an exemplary ramjet-type projectile, a solid-fuel ramjet propulsion system that uses airflow ducts may lead to significant space shortages within the projectile. Due to the volume limitations of the standard space provided in the projectile that is shared by the ramjet propulsion system, seeker hardware and processor electronics, and the warhead, the projectile may be configured with a propulsion system for the initial phase of flight to increase the range of flight to a target. However, conventional projectiles may be deficient in maximizing the range, which relies on either reducing the drag in and around the inlets or increasing the lift of the airframe for the projectile.

One prior attempt to increase the projectile range to a target includes increasing the propulsion section in a ramjet. However, this solution is deficient in that it does not address the source of drag created by the inlets of the air breathing propulsion system after the ramjet fuel is expended, such that the projectile may be subject to inadequate performance.

SUMMARY OF DISCLOSURE

The present application provides a projectile that uses a wing structure to form both an inlet that intakes air for combustion by a propulsion system of the projectile during an initial range of flight and a lift surface for the projectile after the propulsion engine of the propulsion system burns out. In contrast to conventional projectiles which include a ramjet-only variant that provides an optimal time of flight to the target but a shorter range, and a wing-only variant that provides a longer range but an undesirable long flight time, the wing structure that acts as both the inlet and the lift surface enables both a long range and an optimal time of flight to the target.

The wing structure includes at least one wing that is movable from a folded position, in which the wing extends along a propulsion body section of the projectile to define the inlet, to a deployed position, in which the wing extends outwardly from the propulsion body section to form the lift surface. Any number of wings may be provided and the wings may be simultaneously deployed or sequentially deployed depending on the application.

The propulsion body section of the projectile may include a recessed portion that is covered by the wing when the wing is in the folded position, such that the inlet is defined between the propulsion body section and the wing. When the wing is moved away from the propulsion body section, the recessed portion is exposed or opened such that the inlet is opened.

The wing is activated by any suitable actuator and may be rotated away from the propulsion body section to move to the deployed position. The wing may be configured for single-axis rotation or multi-axis rotation in which the wing is pivoted about an attachment point to the propulsion body section and also rotated about its axis. The wing may be formed by two wings that engage each other to define the inlet and disengage each other when the wings are moved from the folded position to the deployed position.

According to an aspect of the disclosure, a projectile includes at least one wing that acts as both an air intaking inlet during propulsion and a lift surface after the propulsion.

According to an aspect of the disclosure, a projectile may include at least one wing that closes an inlet when in a folded position and opens an inlet when in a deployed position.

According to an aspect of the disclosure, a projectile may have a ramjet and an inlet that forms a lift surface after an initial propulsion phase of the ramjet.

According to an aspect of the disclosure, a projectile may include at least one wing that is configured for two-axis rotation when moving from a position in which the wing acts as an inlet to a position in which the wing forms a lift surface.

According to an aspect of the disclosure, a projectile may include at least one wing that is oriented in a same plane when in a position in which the wing acts as an inlet, and when in a position in which the wing forms a lift surface.

According to an aspect of the disclosure, a projectile may include at least one wing that is formed by two wings that are engageable to define an inlet and disengageable to open the inlet and form lift surfaces.

According to an aspect of the disclosure, a projectile may include a plurality of wings that are symmetrically arranged about the projectile and act as air intaking inlets during propulsion and lift surfaces after the propulsion.

According to an aspect of the disclosure, a projectile includes a propulsion body section and at least one wing movable between a folded position, in which the at least one wing extends along the propulsion body section to define an inlet during an initial range of flight of the projectile, and a deployed position, in which the at least one wing extends outwardly from the propulsion body section to form a lift surface for the projectile after the initial range of flight.

According to an embodiment of any paragraph(s) of this summary, the at least one wing may be formed as an inlet wall that closes the inlet when in the folded position and opens the inlet when in the deployed position.

According to an embodiment of any paragraph(s) of this summary, the propulsion body section may include an outer peripheral surface having a recessed portion that is covered by the at least one wing to define the inlet.

According to an embodiment of any paragraph(s) of this summary, the at least one wing may be configured to rotate relative to the propulsion body section from the folded position to the deployed position.

According to an embodiment of any paragraph(s) of this summary, the at least one wing may be configured for two-axis rotation.

According to an embodiment of any paragraph(s) of this summary, the at least one wing may be configured to be rotated in a first rotational plane to a first deployed position and subsequently in a second rotational plane that is perpendicular to the first rotational plane to a second deployed position.

According to an embodiment of any paragraph(s) of this summary, the at least one wing may be configured to pivot about an attachment point and rotate about an axis of the at least one wing.

According to an embodiment of any paragraph(s) of this summary, the at least one wing may include a first wing portion and a second wing portion that are engageable to form the inlet and disengageable to form two lift surfaces by rotating in opposite rotational directions from the folded position to the deployed position.

According to an embodiment of any paragraph(s) of this summary, the at least one wing may be configured to pivot about an attachment point to the propulsion body section by at least 90 degrees.

According to an embodiment of any paragraph(s) of this summary, the at least one wing may be oriented in a same plane when in the folded position and in the deployed position, the at least one wing being pivotable in the same plane.

According to an embodiment of any paragraph(s) of this summary, the at least one wing may be attached to the projectile at an attachment point to the propulsion body section that is aft of the inlet.

According to an embodiment of any paragraph(s) of this summary, the at least one wing may extend perpendicularly from the propulsion body section when the at least one wing is in the deployed position.

According to an embodiment of any paragraph(s) of this summary, the at least one wing may include two or more wings that define two or more inlets between the two or more wings and the propulsion body section.

According to an embodiment of any paragraph(s) of this summary, the two or more inlets may be symmetrically arranged around the propulsion body section.

According to an embodiment of any paragraph(s) of this summary, the two or more inlets may be part of an annular inlet.

According to an embodiment of any paragraph(s) of this summary, the projectile is a solid-fuel ramjet, a liquid-fuel ramjet, or a ducted rocket.

According to an embodiment of any paragraph(s) of this summary, the projectile may include at least one of an electrical motor, a mechanical actuator, a pneumatic actuator, a hydraulic actuator, or an energetic material configured to deploy the wing out of the folded position.

According to another aspect of the disclosure, a ramjet includes a propulsion body section containing a propulsion engine for the ramjet, and at least one wing movable between a folded position, in which the at least one wing extends along the propulsion body section to define an inlet that intakes air for combustion in the propulsion system during an initial range of flight of the projectile, and a deployed position, in which the at least one wing extends outwardly from the propulsion body section to form a lift surface for the projectile after the propulsion engine burns out.

According to an embodiment of any paragraph(s) of this summary, the at least one wing may be configured to rotate from the folded position in which the at least one wing covers a recessed portion formed on an outer periphery of the propulsion body section to the deployed position in which the at least one wing is removed from the recessed portion to open the inlet.

According to still another aspect of the disclosure, a method of operating a projectile includes burning a propulsion engine in a propulsion body section of the projectile during an initial range of flight of the projectile, intaking air through an inlet defined by at least one wing arranged in a folded position against the propulsion body section for combustion in the propulsion engine during the initial range of flight, deploying the at least one wing from the folded position to a deployed position in which the at least one wing extends outwardly from the propulsion body section after the propulsion engine burns out during a subsequent range of flight relative to the initial range of flight, and generating lift for the projectile via the at least one wing being in the deployed position.

To the accomplishment of the foregoing and related ends, the disclosure comprises the features hereinafter fully described and particularly pointed out in the claims. The following description and the annexed drawings set forth in detail certain illustrative embodiments of the disclosure. These embodiments are indicative, however, of but a few of the various ways in which the principles of the disclosure may be employed. Other objects, advantages and novel features of the disclosure will become apparent from the following detailed description when considered in conjunction with the drawings.

BRIEF DESCRIPTION OF DRAWINGS

The annexed drawings, which are not necessarily to scale, show various aspects of the disclosure.

DETAILED DESCRIPTION

The principles described herein have application for use with projectiles, such as artillery rounds or missiles. The projectiles may be implemented in various applications, such as in defense applications or in any other suitable projectile applications including non-military applications. The principles described herein may be implemented in any suitable projectile, such as a solid-fuel ramjet, a liquid-fuel ramjet, or a ducted rocket. Projectile launch systems, such as tube or gun launch systems may also be used in conjunction with the projectiles and principles described herein.

Figure 1:
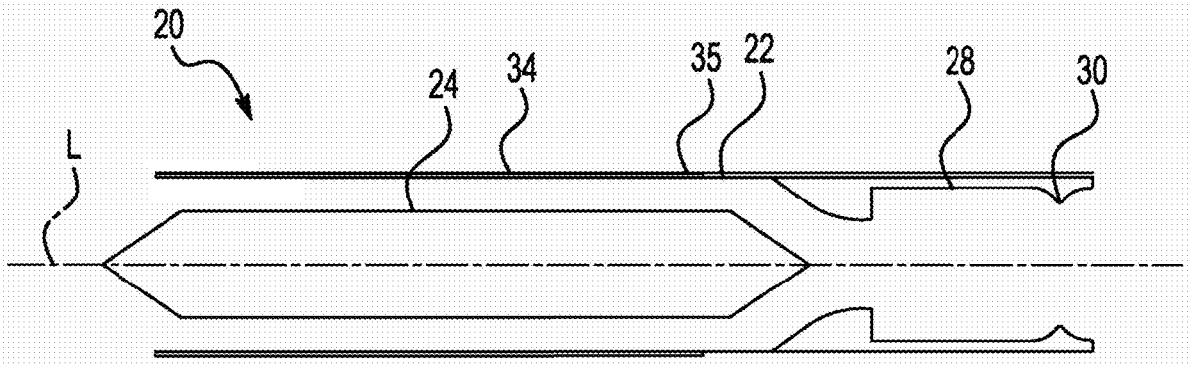
FIG. 1 shows a schematic drawing of a projectile having a propulsion system, with the inlets in a closed position for launch.

Referring first to FIG. 1, a schematic drawing of a projectile 20 is shown. The illustrated configuration is that of a round cross-section configuration, used during initial launch, with inlets initially closed off. The inlets are deployed when transitioning to the ramjet propulsion phase, with the configuration for ramjet propulsion shown in FIG. 2, with the inlets able to take in air for combustion in a propulsion system. The projectile 20 may be a solid-fuel ramjet, a liquid-fuel ramjet, a ducted rocket, or any other suitable projectile. For example, the projectile 20 may be a ramjet that includes a propulsion body section 22 having a propulsion system and engine for the ramjet. The propulsion body section 22 houses various components of the propulsion engine. A diffuser 24 may be arranged in the propulsion body section 22 and an air intaking inlet 26 may be defined between the diffuser 24 and the propulsion body section 22. A combustion chamber 28 is arranged downstream the inlet 26 and a nozzle 30 is arranged downstream the combustion chamber 28.

In operation, the inlet 26 is configured to intake surrounding air and compress the air during forward movement of the projectile 20. The propulsion engine of the ramjet-type projectile 20 uses the forward motion of the projectile 20 to compress the incoming air for combustion without a rotating compressor. The combustion chamber 28 is fluidly connected to the inlet 26 to receive the compressed air. In the combustion chamber 28, heat is added to the compressed air by adding fuel and burning the fuel. In the nozzle 30, the density of the air is decreased to increase the acceleration of the heated air and produce thrust for the projectile 20.

During initial launch of the projectile 20, the inlet 26 may be in a closed position during the initial launch to reduce drag prior to propulsion of the projectile 20. The projectile 20 may be launched from a gun or any other suitable launch system. After the projectile 20 exits the gun, the inlet 26 may be activated and opened during an initial range of flight of the projectile 20. During the initial range of flight, the inlet 26 intakes air for combustion by the forward motion of the projectile 20, such that the initial range of flight is a propulsion phase of the ramjet-type projectile 20. The inlet 26 is defined by at least one wing 34 having a folded position in which the wing 34 extends along the propulsion body section 22 during the initial range of flight of the projectile 20, as shown in FIG. 1.

Figure 2:
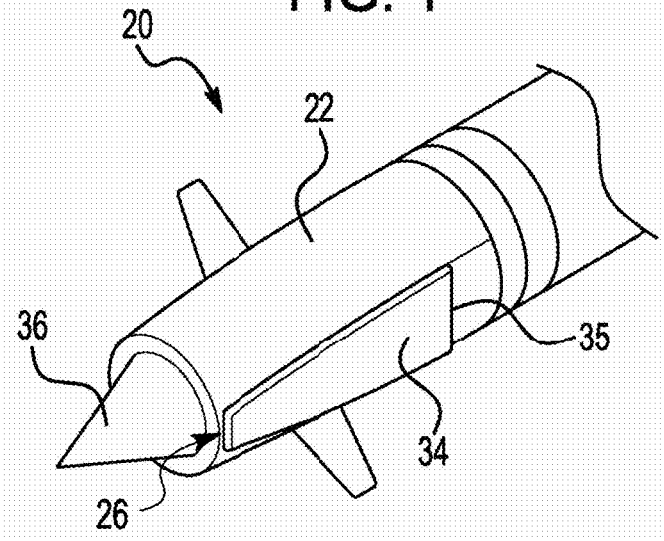
FIG. 2 shows the projectile of FIG. 1 during an initial range of flight in which wings of the projectile are in a folded position to define an inlet.
Figure 3:
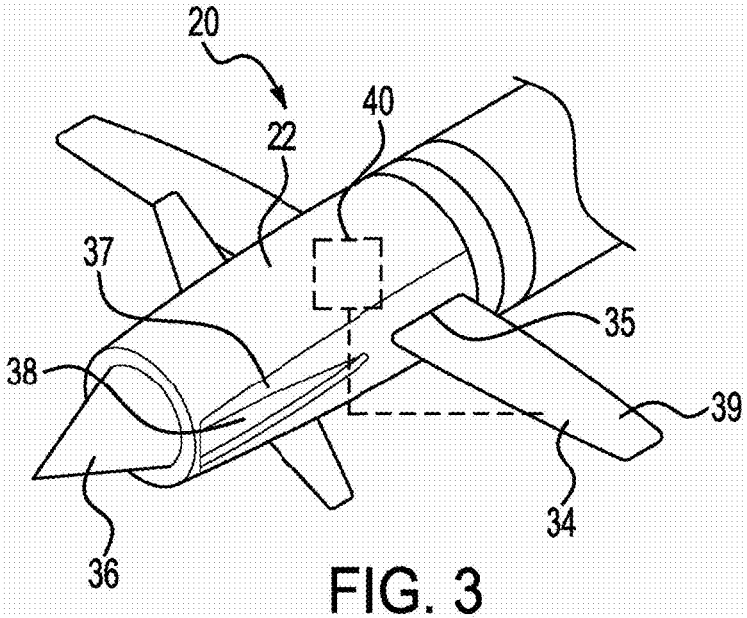
FIG. 3 shows the projectile of FIG. 2 during a subsequent range of flight in which the wings of the projectile are deployed to form a lift surface.

Referring in addition to FIGS. 2 and 3, further details of the wing 34 are shown. FIG. 2 shows the projectile 20 during the initial range of flight in which the wing 34 is in the folded position to form the inlet 26 shown in FIG. 1. After the propulsion engine burns out and the initial range of flight is ended, the wing 34 is movable from the folded position shown in FIG. 2 to a deployed position in which the wing 34 extends outwardly from the propulsion body section 22, as shown in FIG. 3. An attachment point 35 at which the wing 34 is attached to the projectile 20 may be aft to the inlet 26 relative to a front end 36 of the projectile. The attachment point 35 is formed at a fixed location along the propulsion body section 22. The wing 34 is configured for rotation about the attachment point 35 from the folded position to the deployed position. For example, the wing 34 may be pivoted about the attachment point 35. When in the deployed position, the wing 34 forms a lift surface to generate lift for the projectile 20 after the initial range of flight. Accordingly, the inlet 26 that was once creating drag for the projectile 20 is removed to create lift and further increase the flight range of the projectile 20.

The wing 34 acts as both the inlet for the projectile 20 during an initial propulsion phase and as a lift surface during flight of the projectile 20 after the propulsion phase. In contrast, conventional projectiles may be a wings-only variant or a ramjet-only variant. In the wings-only variant, the projectile has lift wings without an inlet configured to intake air during propulsion. In the ramjet-only variant, the projectile has the inlet without any sort of lift surface to increase the flight range of the projectile after the propulsion phase.

The wings-only variant may provide a longer range, but also provides an undesirably long time of flight time to a target, whereas the ramjet-only variant provides an optimal time of flight the target, but also provides an undesirably shorter range to the target, such that both variants are deficient. Using the wing 34 that acts as both an air intake inlet and a lift surface captures the advantages of both variants in a single projectile in that the wing 34 enables both a long range of the projectile 20 and an optimal time of flight to a target.

The wing 34 is formed as an inlet wall that closes the inlet 26 when in the folded position and moves away from the propulsion body section to expose or open the inlet 26 when in the deployed position, such that the inlet 26 can no longer be utilized to intake air for propulsion. As shown in FIG. 3, the propulsion body section 22 has an outer peripheral surface 37 with a recessed portion 38 that is covered by the wing 34 to form the inlet 26 when the wing 34 is in the folded position. The inlet 26 is thus defined between the propulsion body section 22 and the wing 34.

The recessed portion 38 may have any suitable shape and extends parallel to the longitudinal axis L of the propulsion body section 22. The wing 34 also extends parallel to the longitudinal axis L when in the folded position. For example, the recessed portion 38 may have a shallow depth and is elongated along the length of the propulsion body section 22. The length of the recessed portion 38 may be dependent on the desired size for the inlet 26 based on the operating characteristics for the projectile 20. The inlet 26 may have any suitable shape, such as annular.

The wing 34 may have any suitable shape and length. The wing 34 may extend along more than half or most of a length of the propulsion body section 22. The length of the wing 34 may be dependent on the desired length of the inlet 26. The wing 34 may be shaped to have a planar body with a small thickness and an elongated length. A planar surface 39 of the wing 34 may be formed such that the wing 34 is able to mate with the outer peripheral surface 37 of the propulsion body section 22 when the wing 34 is engaged against the outer peripheral surface 37 to cover the recessed portion 38.

The outer peripheral surface 37 and the planar surface 39 of the wing 34 may be formed to have a complementary shape such that the wing 34 is fitted to the outer peripheral surface 37 when in the folded position. The planar surface 39 may have a tapered shape that tapers from the attachment point 35 at the propulsion body section 22 to an opposite end of the wing 34. When in the deployed position, the wing 34 may extend perpendicular or transversely relative to the longitudinal axis L defined by the propulsion body section 22. The wing 34 may have many other shapes.

As schematically shown in FIG. 3, the projectile 20 includes an actuator 40 that is arranged within the propulsion body section 22 and is configured to deploy the wing 34 out of the folded position and into the deployed position. Any suitable actuator may be used. Exemplary actuators may include an electrical motor, a mechanical actuator, a pneumatic actuator, a hydraulic actuator, or an energetic material. The actuator 40 may include any suitable pistons, cylinders, pumps, motors, valves, etc. Actuation of the wing 34 occurs after the propulsion engine burns out and the initial range of flight of the projectile 20 ends, such that lift for the projectile 20 to increase the range is desired.

Any number of wings 34 and inlets 26 may be provided. Two or more wings 34 may be provided. Each wing 34 may correspond to a single inlet 26 formed between the corresponding wing 34 and the propulsion body section 22, such that the projectile 20 includes a plurality of inlets 26. Each wing 34 may share one actuator 40 or have a unique actuator, such that the wings 34 may be deployed simultaneously or sequentially. The actuation sequence of the wings 34 may be dependent on the application and the desired lift operation. The wings 34 may be symmetrically spaced about a common circumference of the propulsion body section 22. Other arrangements of the wings 34 may be suitable depending on the application. As shown in FIG. 3, in an exemplary embodiment, the projectile 20 may include two wings 34 that form two inlets 26 that are diametrically opposed to each other. In exemplary embodiments, two or more inlets may be part of an annular inlet for the projectile 20.

Figure 4:
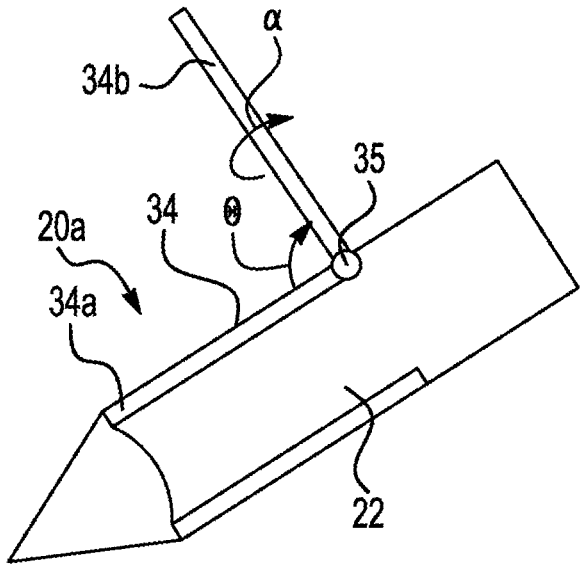
FIG. 4 shows the wing of the projectile of FIG. 1 according to an exemplary embodiment in which the wing is configured for two-axis rotation to move from the folded position to a deployed position.
Figure 5:
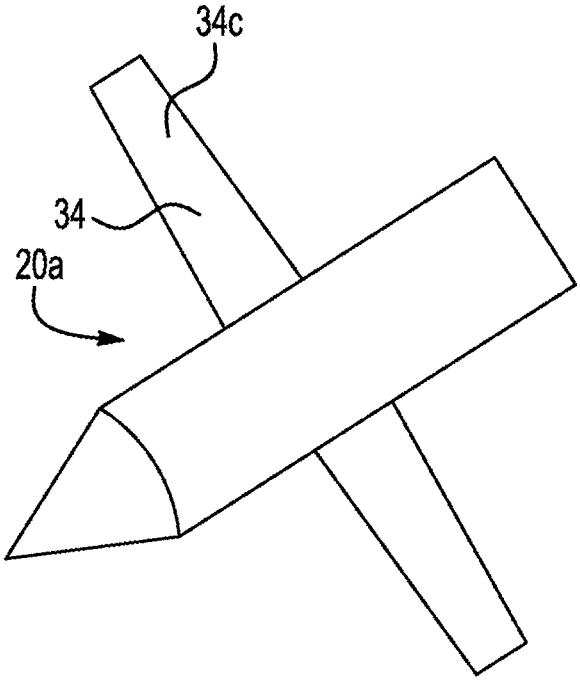
FIG. 5 shows the wing of FIG. 4 in the deployed position.

Referring now to FIGS. 4-9, one or more wings 34 may be rotated when moving from the folded position to the deployed position. Rotating the wing 34 may include pivoting. Each wing 34 may be rotatable or pivotable by an angle that is at least 90 degrees. A smaller or larger angle of rotation or pivoting may be suitable depending on the application and the final deployed position of the wing 34. As shown in FIGS. 4 and 5, the wing 34 may be configured for two-axis rotation from the folded position 34*a* to the deployed position 34*b*, in a first exemplary embodiment of the projectile 20*a*. During deployment of the wing 34, the wing 34 has a first range of rotation θ in a first rotational plane, and a second range of rotation α that occurs in a second rotational plane that is perpendicular to the first rotational plane in which the first range of rotation θ occurs.

For example, the wing 34 may pivot approximately 90 degrees about the attachment point 35 away from the propulsion body section 22 during the first range of rotation θ, such that the wing 34 is pivoted to extend perpendicular to the propulsion body section 22 in a first deployed position 34*b*. The attachment point 35 may include any suitable hinge mechanism, joint, or other linkage that is attached to the propulsion body section 22. A two-axis hinge mechanism may be suitable in exemplary embodiments. The attachment point 35 may include any suitable components such as ball bearings, springs, leaves, pins, tubes, clips, etc. The wing 34 may rotate more or less than 90 degrees during the first range of rotation θ.

The wing 34 also rotates in the second range of rotation α, which may occur subsequently to the first range of rotation θ. For example, the wing 34 may rotate approximately 90 degrees from the first deployed position 34*b* shown in FIG. 4, which may be an initial deployed position, to the second deployed position 34*c* shown in FIG. 5, which may be a final deployed position. The wing 34 may rotate about its own axis during the second range of rotation α. In the second or final deployed position 34*c*, the planar surface of the wing 34 may extend in a plane that is parallel with the rotational plane of the first range of rotation θ. Two or more wings may be provided that are subject to the same two-axis rotation deployment shown in FIGS. 4 and 5. The two or more wings may be deployed simultaneously, or sequentially.

In an alternative embodiment, the wing 34 may rotate about its own axis during the first range of rotation θ, such that the wing 34 extends parallel to the propulsion body section 22 when in the first deployed position 34*b*. The wing 34 may then pivot outwardly from the propulsion body section 22 during the second range of rotation α to the second deployed position 34*b* shown in FIG. 5. In still other exemplary embodiments, the wing 34 may be configured to rotate about its axis while simultaneously pivoting about the attachment point 35. In still other exemplary embodiments, the wing 34 may be configured for multi-axis deployment in which the wing 34 may be rotated or pivoted about three or more different axes. The rotation of the wing 34 may be dependent on the desired lift profile for the projectile 20*a*.

Figure 6:
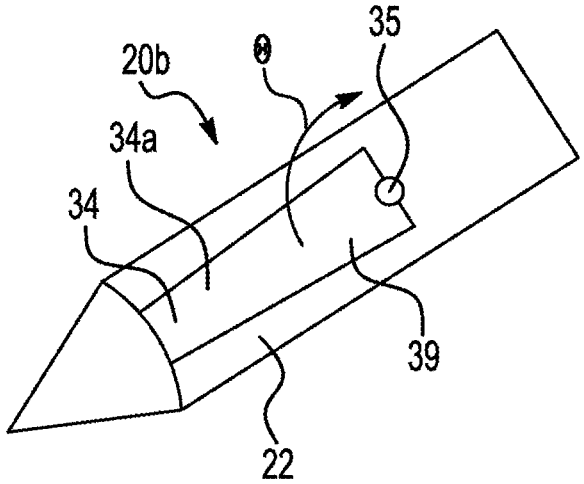
FIG. 6 shows the wing of the projectile of FIG. 1 according to another exemplary embodiment in which the wing is configured for single-axis rotation to move from the folded position to the deployed position.
Figure 7:
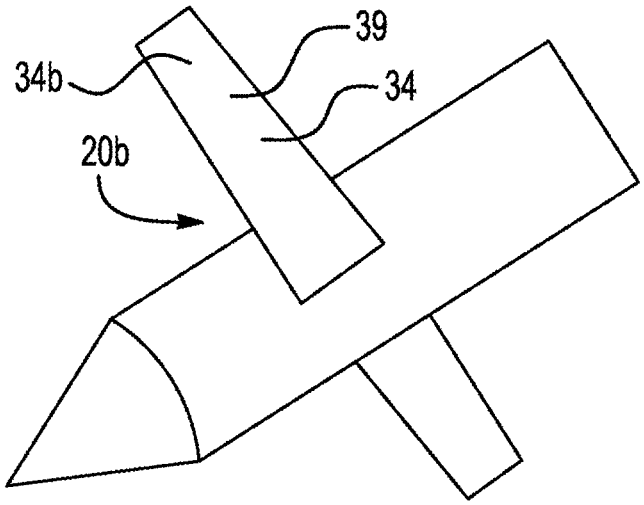
FIG. 7 shows the wing of FIG. 6 in the deployed position.

As shown in FIGS. 6 and 7, the wing 34 may be configured for single-axis rotation in which only one range of rotation θ occurs, in another exemplary embodiment of the projectile 20*b*. The wing 34 may pivot about the attachment point 35 from the folded position 34*a* shown in FIG. 6 to the deployed position 34*b* shown in FIG. 7, which may be the final deployed position of the wing 34. The wing 34 may pivot at least 90 degrees, but the wing 34 may pivot more or less than 90 degrees depending on the application. The planar surface of the wing 34 may extend in the rotational plane of the range of rotation θ. Given that the wing 34 has single-axis rotation, the wing 34 is oriented in a same plane in both the folded position 34*a* and the deployed position 34*b*. This plane is the same plane as the rotation plane of the wing 34. Two or more wings may be provided that are subject to the same deployment operation shown in FIGS. 6 and 7.

Figure 8:
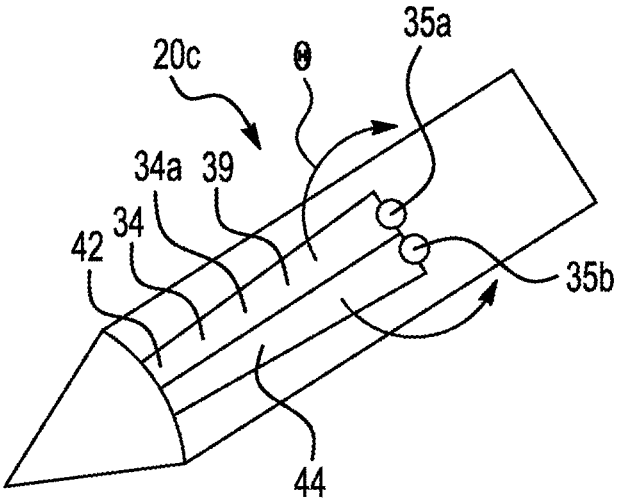
FIG. 8 shows the wing of the projectile of FIG. 1 according to still another exemplary embodiment in which the wing is formed by two wings that engage each other to define the inlet when in the folded position.
Figure 9:
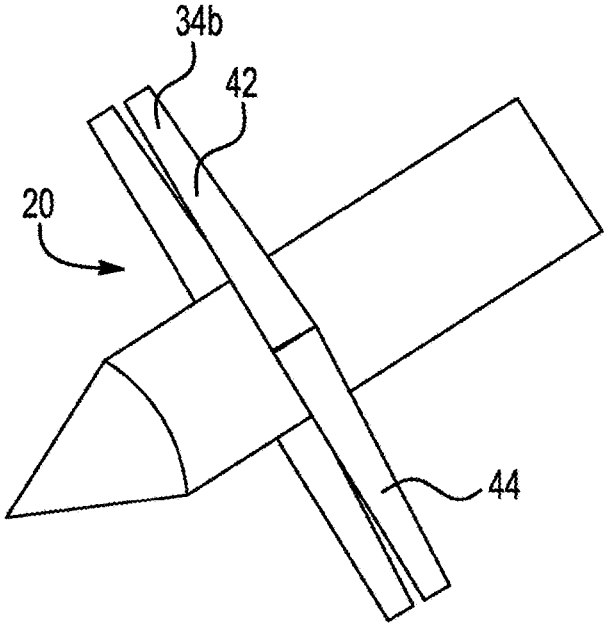
FIG. 9 shows the wings of FIG. 9 in the deployed position in which the wings form two lift surfaces.

As shown in FIGS. 8 and 9, the wing 34 may be formed by a first wing portion 42 and a second wing portion 44, in still another exemplary embodiment of the projectile 20*c*. The wing portions 42, 44 are engageable with each other to close or form the inlet 26 (shown in FIG. 1) when the wing 34 is in the folded position 34*a* shown in FIG. 8. After the initial range of flight or propulsion phase of the projectile 20*c*, each of the wing portions 42, 44 may have a single range of rotation θ. During the single range of rotation θ, the wing portions 42, 44 rotate in opposite rotational directions relative to each other to disengage and open the inlet 26 when moving from the folded position 34*a* shown in FIG. 8 to the deployed position 34*b* shown in FIG. 9.

Each of the wing portions 42, 44 may rotate at least 90 degrees, or more or less than 90 degrees depending on the application. The planar surface 39 of each of the wing portions 42, 44 may extend in the rotational plane of the range of rotation θ, such that the wing portions 42, 44 are oriented in a same plane in both the folded position 34*a* and the deployed position 34*b*. Each wing portion 42, 44 may have a separate attachment point 35*a*, 35*b* and a separate hinge mechanism. Alternatively, the wing portions 42, 44 may share an attachment point and hinge mechanism. Two or more wings may be provided that are subject to the same deployment operation shown in FIGS. 8 and 9. As shown in FIG. 9, each wing 34 may be formed by two engageable wing portions 42, 44. In other exemplary embodiments, the wing portions 42, 44 may also be configured for two-axis or multi-axis rotation, as shown in FIGS. 4 and 5.

Figure 10:
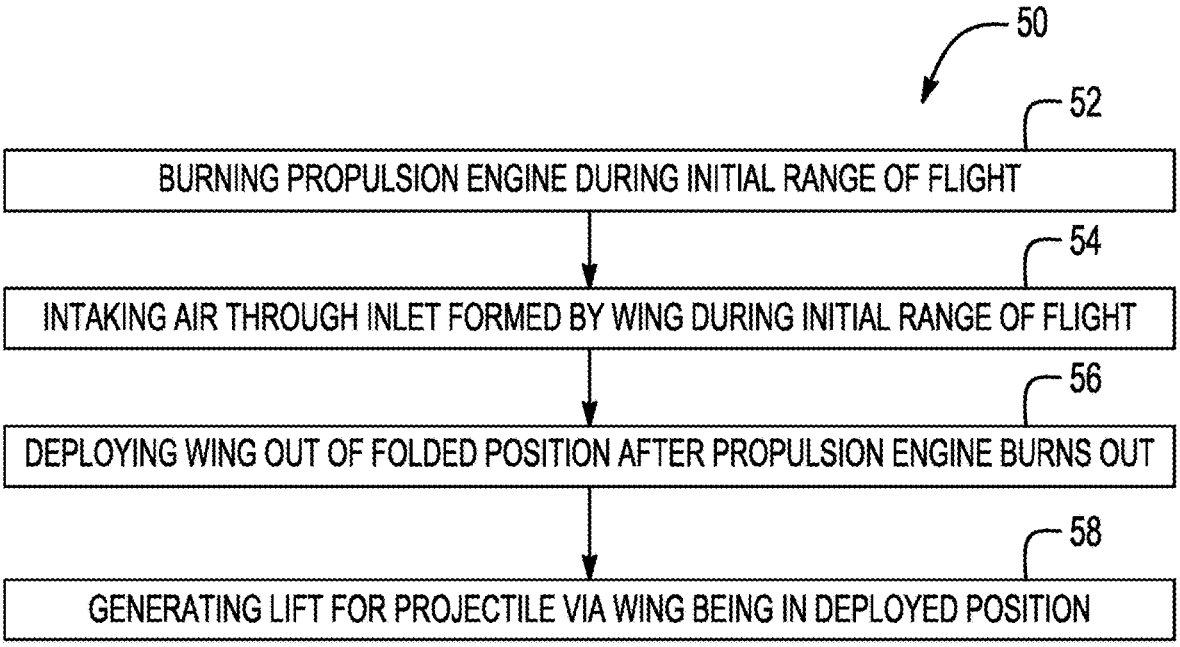
FIG. 10 shows a flowchart illustrating a method of operating a projectile, such as the projectile shown in any one of FIGS. 1-9.

Referring now to FIG. 10, a method 50 of operating a projectile is shown. The method 50 may be used to operate the projectile 20, 20*a*, 20*b*, 20*c* shown in any of FIGS. 1-9. A first step 52 of the method 50 includes burning a propulsion engine in a propulsion system of the propulsion body section 22 of the projectile 20, 20*a*, 20*b*, 20*c* during an initial range of flight of the projectile 20, 20*a*, 20*b*, 20*c*. Step 54 of the method 50 includes intaking air through an inlet 26 formed between the propulsion body section 22 and at least one wing 34 arranged in a folded position against the propulsion body section 22 for combustion in the propulsion engine during the initial range of flight.

Step 56 of the method 50 includes deploying the wing 34 from the folded position to a deployed position in which the wing 34 extends outwardly from the propulsion body section 22 to open the inlet 26 after the propulsion engine burns out during a subsequent range of flight relative to the initial range of flight. The wing 34 may be deployed as shown in any of FIGS. 4-9. Step 58 of the method 50 includes generating lift for the projectile 20, 20*a*, 20*b*, 20*c* via the at least one wing 34 being in the deployed position.

Using a wing as both an inlet and a lift surface is advantageous in that the projectile configuration preserves the benefit of an air-breathing propulsion system to minimize flight times, while also using the surface area of the existing inlet to extend the range by the wing becoming a lifting surface on the airframe. In an exemplary application, the projectile using the dual-function wing described herein may have a maximum range of approximately 160 kilometers and a speed of Mach 1.8. In contrast, a wings-only projectile variant has a maximum range of approximately 140 kilometers and a speed of 0.4 Mach, and a ramjet-only projectile variant has a maximum range of approximately 120 kilometers and a speed of 2.0 Mach. Accordingly, the projectile according to the present application has improved target range and an optimal time of flight.

Although the disclosure shows and describes certain preferred embodiment or embodiments, it is obvious that equivalent alterations and modifications will occur to others skilled in the art upon the reading and understanding of this specification and the annexed drawings. In particular regard to the various functions performed by the above described elements (external components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the disclosure. In addition, while a particular feature of the disclosure may have been described above with respect to only one or more of several illustrated embodiments, such feature may be combined with one or more other features of the other embodiments, as may be desired and advantageous for any given or particular application.

What is claimed is:

1. A projectile comprising:

a propulsion body section; and at least one wing movable between a folded position, in which the at least one wing extends along the propulsion body section to define an inlet between a recessed portion of an outer peripheral surface of the propulsion body, and the at least one wing, which is over the recessed portion, during an initial range of flight of the projectile, and a deployed position, in which the at least one wing extends outwardly from the propulsion body section to form a lift surface for the projectile after the initial range of flight.

2. The projectile according to claim 1, wherein the at least one wing is formed as an inlet wall that in part defines the inlet when in the folded position, and moves away from the inlet when in the deployed position.

3. The projectile according to claim 1, wherein the at least one wing is configured to rotate relative to the propulsion body section from the folded position to the deployed position.

4. The projectile according to claim 3, wherein the at least one wing is configured for two-axis rotation.

5. The projectile according to claim 4, wherein the at least one wing is configured to rotate in a first rotational plane to a first deployed position, and subsequently in a second rotational plane that is perpendicular to the first rotational plane to a second deployed position.

6. The projectile according to claim 4, wherein the at least one wing is configured to pivot about an attachment point and rotate about an axis of the at least one wing.

7. The projectile according to claim 3, wherein the at least one wing includes a first wing portion and a second wing portion that are engageable to form the inlet and disengageable to form two lift surfaces by rotating in opposite rotational directions from the folded position to the deployed position.

8. The projectile according to claim 3, wherein the at least one wing is configured to pivot about an attachment point to the propulsion body section by at least 90 degrees.

9. The projectile according to claim 8, wherein the at least one wing is oriented in a same plane when in the folded position and in the deployed position, the at least one wing being pivotable in the same plane.

10. The projectile according to claim 1, wherein the at least one wing is attached to the projectile at an attachment point to the propulsion body section that is aft to the inlet.

11. The projectile according to claim 1, wherein the at least one wing extends perpendicularly from the propulsion body section when the at least one wing is in the deployed position.

12. The projectile according to claim 1, wherein the at least one wing includes two or more wings that define two or more inlets between the two or more wings and the propulsion body section.

13. The projectile according to claim 12, wherein the two or more inlets are symmetrically arranged around the propulsion body section.

14. The projectile according to claim 1, wherein the projectile is a solid-fuel ramjet, a liquid-fuel ramjet, or a ducted rocket.

15. The projectile according to claim 1 further comprising at least one of an electrical motor, a mechanical actuator, a pneumatic actuator, a hydraulic actuator, or an energetic material configured to deploy the wing out of the folded position.

16. A ramjet comprising:

a propulsion body section containing a propulsion engine for the ramjet; and at least one wing movable between a folded position, in which the at least one wing extends along the propulsion body section to define an inlet between a recessed portion of an outer peripheral surface of the propulsion body, and the at least one wing, which is over the recessed portion, that intakes air for combustion in the propulsion system during an initial range of flight of the projectile, and a deployed position, in which the at least one wing extends outwardly from the propulsion body section to form a lift surface for the projectile after the propulsion engine burns out.

17. The ramjet according to claim 16, wherein the at least one wing is configured to rotate from the folded position, to the deployed position in which the at least one wing is removed from the recessed portion to open the inlet.

18. A method of operating a projectile, the method comprising:

burning a propulsion engine in a propulsion body section of the projectile during an initial range of flight of the projectile;

intaking air through an inlet defined by at least one wing arranged in a folded position against the propulsion body section for combustion in the propulsion engine during the initial range of flight, with the inlet between a recessed portion of an outer peripheral surface of the propulsion body, and the at least one wing, which is over the recessed portion;

deploying the at least one wing from the folded position to a deployed position in which the at least one wing extends outwardly from the propulsion body section after the propulsion engine burns out during a subsequent range of flight relative to the initial range of flight; and generating lift for the projectile via the at least one wing being in the deployed position.

* * * * *